US008516840B2

(12) United States Patent
Debesa

(10) Patent No.: US 8,516,840 B2
(45) Date of Patent: Aug. 27, 2013

(54) SOLAR POWERED AIR CONDITIONER

(76) Inventor: Ramon E. Debesa, Hialeah, FL (US)

( * ) Notice: Subject to any disclaimer, the term of this patent is extended or adjusted under 35 U.S.C. 154(b) by 385 days.

(21) Appl. No.: 12/978,290

(22) Filed: Dec. 23, 2010

(65) Prior Publication Data

US 2012/0159979 A1 Jun. 28, 2012

(51) Int. Cl.
*F25B 27/00* (2006.01)
*F25D 9/00* (2006.01)

(52) U.S. Cl.
USPC ..... 62/235.1; 62/401; 62/402

(58) Field of Classification Search
USPC ..... 62/235.1, 236, 401, 402
See application file for complete search history.

(56) References Cited

U.S. PATENT DOCUMENTS

| | | | | | |
|---|---|---|---|---|---|
| 1,602,938 | A * | 10/1926 | Riesner | 417/27 |
| 3,889,742 | A | 6/1975 | Rush et al. | |
| 4,367,633 | A * | 1/1983 | Strathman | 62/236 |
| 4,474,028 | A * | 10/1984 | Miller et al. | 62/235.1 |
| 4,517,958 | A | 5/1985 | Worf | |
| 5,259,363 | A | 11/1993 | Peacock | |
| 6,002,220 | A * | 12/1999 | Takahashi et al. | 318/139 |
| 6,134,902 | A * | 10/2000 | Curry | 62/236 |
| 6,590,793 | B1 * | 7/2003 | Nagao et al. | 363/95 |
| 6,880,553 | B2 | 4/2005 | Liu et al. | |
| 7,810,489 | B2 | 10/2010 | Liu et al. | |
| 7,814,764 | B1 * | 10/2010 | Heater et al. | 62/476 |
| 2008/0218917 | A1 * | 9/2008 | Archer | 361/33 |

* cited by examiner

*Primary Examiner* — Brandon M Rosati
*Assistant Examiner* — Elizabeth Martin
(74) *Attorney, Agent, or Firm* — Ruben Alcoba, Esq.; Craig S. Kirsch, Esq.

(57) ABSTRACT

A solar powered air conditioner comprising of at least one solar panel, an inverter that converts the DC voltage created by the solar panels to AC voltage connected to the solar panel, a battery charger that receives the AC voltage from the inverter and converts the AC voltage to DC voltage, a charge controller connected to the battery charger, a rechargeable battery connected to the charge controller, a contactor connected to the rechargeable battery and to a thermostat, a DC powered motor connected to the contactor, and an air conditioning system, the air conditioning system having an air compressor and an air conditioning motor, the air compressor connects to the DC powered motor via a belt, and the air conditioner motor connects to the contactor.

1 Claim, 1 Drawing Sheet

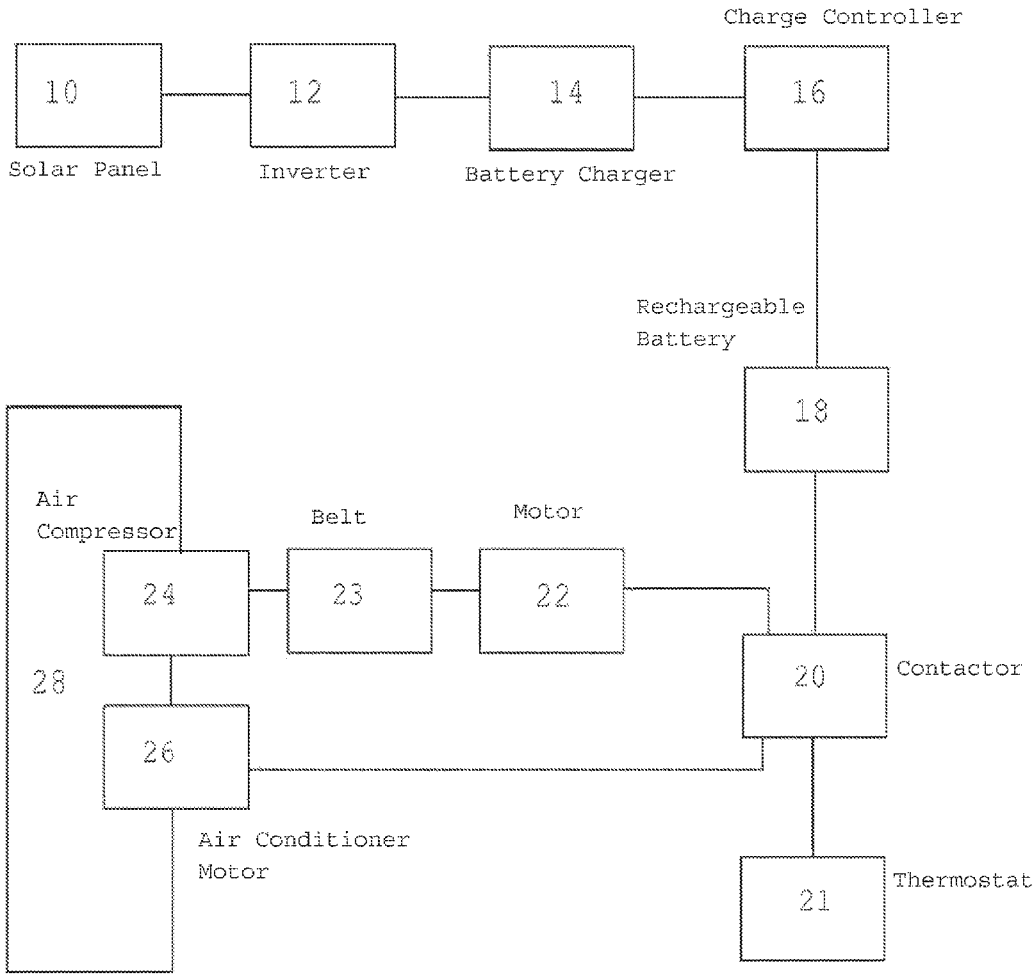
Charge Controller
10
12
14
16
Solar Panel
Inverter
Battery Charger
Rechargeable
Battery
18
Air
Compressor
Belt
Motor
24
23
22
28
20
Contactor
26
Air Conditioner
Motor
21
Thermostat

SOLAR POWERED AIR CONDITIONER

BACKGROUND

The present invention relates to an energy saving solar powered air conditioner.

The inventor of the present invention is an air conditioning technician that decided to reduce his electric bill by developing an air conditioner that would be solely dependent on solar power. After developing the air conditioner, the inventor realized that most home owners would install a solar dependent air conditioner in their homes if the cost of installation was reasonable.

Using a cost to benefit analysis, he understood that for most people to purchase a solar dependent air conditioner that the solar powered air conditioner had to be economical to manufacture and install. He further realized that most people would not change their air conditioners if their existing air conditioners were functional and there was no immediate financial return for changing to a solar powered air conditioner. By changing to a solar powered air conditioner, any person choosing to change to solar power would derive benefits immediately.

By providing the solar air conditioner of the present invention, the inventor knew that he would also be helping the environment, for less fossil fuels would be consumed to cool homes.

U.S. Pat. No. 6,880,553, Liu et al., discloses a solar air-conditioning system that is not similar to the present invention, yet it discloses drawbacks of using existing systems used to power or cool homes. The present invention is solely directed to providing consumers with an economical solar powered air conditioner that would allow most homeowners to switch to a solar power cooling system.

For the foregoing reasons, there is a need for a solar powered air conditioner that will be economical to manufacture, that will reduce the consumption of fossil fuels, and that will be solar powered.

SUMMARY

The present invention is directed to a solar powered air conditioner that is economical to manufacture, that reduces the consumption of fossil fuels, and that is solar powered.

The solar powered air conditioner of the present invention comprises of at least one solar panel that generates at least 3000 Watts of energy and that delivers at least 12 DC voltage, an inverter that converts the DC voltage created by the solar panels to at least 110 AC voltage connected to the solar panel, a battery charger that receives the AC voltage from the inverter and converts the AC voltage to at least 6 to no more than 180 DC voltage, a charge controller connected to the battery charger, a rechargeable battery connected to the charge controller, the rechargeable battery is of at least 6 to no more than 180 DC Voltage, a contactor connected to the rechargeable battery and to a thermostat, a DC powered motor being of at least 6 to more than 180 DC voltage that can generate at least one horsepower of energy connected to the contactor, and an air conditioning system, the air conditioning system having an air compressor and an air conditioning motor being of at least 6 to more than 180 DC voltage, the air compressor connects to the DC powered motor via a belt, and the air conditioner motor connects to the contactor.

The present invention is a standalone air conditioner that does not require any outside source of electricity besides the solar panels.

An object of the present invention is to provide an air conditioner that can be solar powered.

Another object of the present invention is to provide a solar powered air conditioner that will be inexpensive to manufacture.

Yet another object of the present invention is to provide a solar powered air conditioner that will encourage consumers to purchase it.

A further object of the present invention is to provide an air conditioner that will reduce the consumption of fossil fuels.

DRAWINGS

These and other features, aspects, and advantages of the present invention will become better understood with regard to the following description, appended claims, and drawings where:

FIG. 1 is a flow chart showing the solar powered air conditioner of the present invention.

DESCRIPTION

As seen in FIG. 1, a solar powered air conditioner comprises of at least one solar panel 10 that generates at least 3000 Watts of energy and that delivers at least 12 DC voltage, an inverter 12 that converts the DC voltage created by the solar panels 10 to at least 110 AC voltage connected to the solar panel 10, a battery charger 14 that receives the AC voltage from the inverter 12 and converts the AC voltage to at least 6 to no more than 180 DC voltage, a charge controller 16 connected to the battery charger 14, a rechargeable battery 18 connected to the charge controller 16, the rechargeable battery 18 is of at least 6 to no more than 180 DC voltage, a contactor 20 connected to the rechargeable battery 18 and to a thermostat 21, a DC powered motor 22 being of at least 6 to no more than 180 DC voltage that can generate at least one horsepower of energy connected to the contactor 20, and an air conditioning system 28, the air conditioning system 28 having an air compressor 24 and an air conditioner motor 26 being of at least 6 to more than 180 DC voltage, the air compressor 24 of the air conditioning system 28 connects to the DC powered motor 22 via a belt 23, and the air conditioner motor 26 connects to the contactor 20.

In a preferred embodiment, the solar powered air conditioner has the following specifications: the solar panel generates 3000 Watts and delivers a 12 DC voltage; the inverter converts the DC voltage to a 110 AC voltage; the battery charger converts the AC voltage to a 36 DC voltage; the rechargeable battery is a 36 DC voltage battery; and the DC powered motor and the air conditioner motor are 36 DC voltage motors.

The connections of the present invention are made using standard electrical wires (not numbered in FIG. 1).

In another embodiment of the present invention, the rechargeable battery is a battery bank of at least six 6 DC voltage batteries (not shown in FIG. 1) connected in series.

An advantage of the present invention is that it provides an air conditioner that can be solar powered.

Another advantage of the present invention is that it provides a solar powered air conditioner that is inexpensive to manufacture.

Yet another advantage of the present invention is that it provides a solar powered air conditioner that encourages consumers to purchase it.

A further advantage of the present invention is that it provides an air conditioner that reduces the consumption of fossil fuels.

Although the present invention has been described in considerable detail in reference to preferred versions, other versions are possible. Therefore, the spirit and scope of the appended claims should not be limited to the description of the preferred versions contained herein.

What is claimed is:

1. A solar powered air conditioner consisting of:

at least one solar panel that generates 3000 Watts of energy and that delivers 12 DC voltage;

an inverter, that converts the 12 DC voltage created by the solar panels to 110 AC voltage, connected to the solar panels;

a battery charger that receives the 110 AC voltage from the inverter and converts the 110 AC voltage to 36 DC voltage;

a charge controller connected to the battery charger;

a rechargeable battery connected to the charge controller, the rechargeable battery is a rechargeable battery bank having a 36 DC voltage, comprised of six 6 DC voltage batteries connected in series;

a contactor connected to the rechargeable battery and to a thermostat;

a 36 DC voltage powered motor, that can generate one horsepower of energy, connected to the contactor; and an air conditioning system, the air conditioning system comprising:

an air compressor, the air compressor connects to the 36 DC voltage powered motor via a belt; and 36 DC voltage air conditioning motor, the air conditioner motor connects to contactor.

* * * * *